United States Patent [19]

Ennis

[11] Patent Number: 5,069,416

[45] Date of Patent: Dec. 3, 1991

[54] DISPLAY FIXTURE FOR SPECTACLES

[75] Inventor: Jan S. Ennis, Redmond, Wash.

[73] Assignee: Ennco Display Systems, Inc., Redmond, Wash.

[21] Appl. No.: 629,276

[22] Filed: Dec. 17, 1990

[51] Int. Cl.[5] ..... A47F 5/00

[52] U.S. Cl. ..... 248/902; 248/291; 248/231.8; 211/13

[58] Field of Search ..... 248/231.8, 902, 291; 211/13

[56] References Cited

U.S. PATENT DOCUMENTS

| | | | |
|---|---|---|---|
| 3,552,701 | 1/1971 | Montagano | 211/13 X |
| 3,924,750 | 12/1975 | Dunchock | 211/13 |
| 4,011,953 | 3/1977 | Engelman | 211/13 |
| 4,128,224 | 12/1978 | Guichard | 248/902 X |
| 4,558,788 | 12/1985 | Grothaus | 248/902 X |
| 4,724,966 | 2/1988 | Benaksas | 211/13 |
| 4,787,520 | 11/1988 | Pearson | 211/13 |
| 4,805,781 | 2/1989 | Tegal | 248/902 X |
| 4,830,480 | 5/1989 | Ennis | 211/13 X |
| 4,903,925 | 2/1990 | Park | 248/902 X |
| 4,930,740 | 6/1990 | Vogt | 211/13 X |

*Primary Examiner*—Alvin C. Chin-Shue

*Attorney, Agent, or Firm*—Jensen & Puntigam

[57] ABSTRACT

A spectacle display device wherein the nose piece (12) is removably mounted to an acrylic rod by clip (4) and the interaction between the serrated back (22) of the nose piece and the ridge (20) along mounting face (8) permits relative angular placement therebetween.

4 Claims, 1 Drawing Sheet

FIG. 1
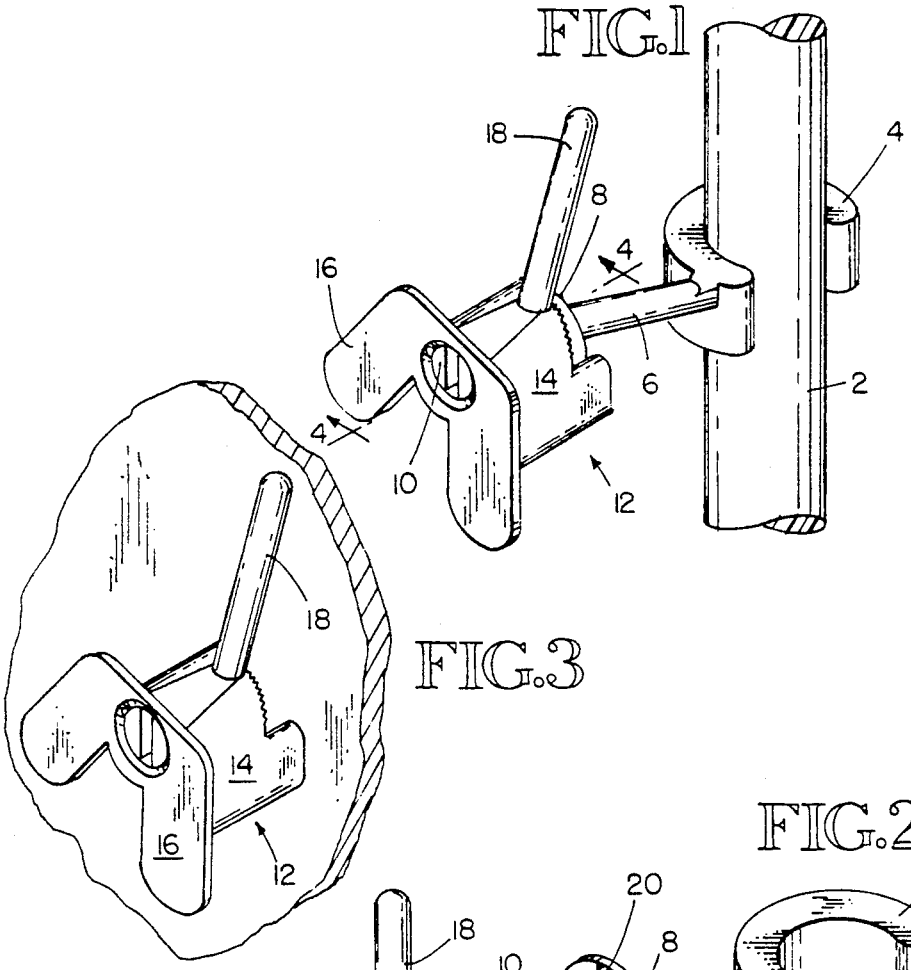
FIG. 3
FIG. 2
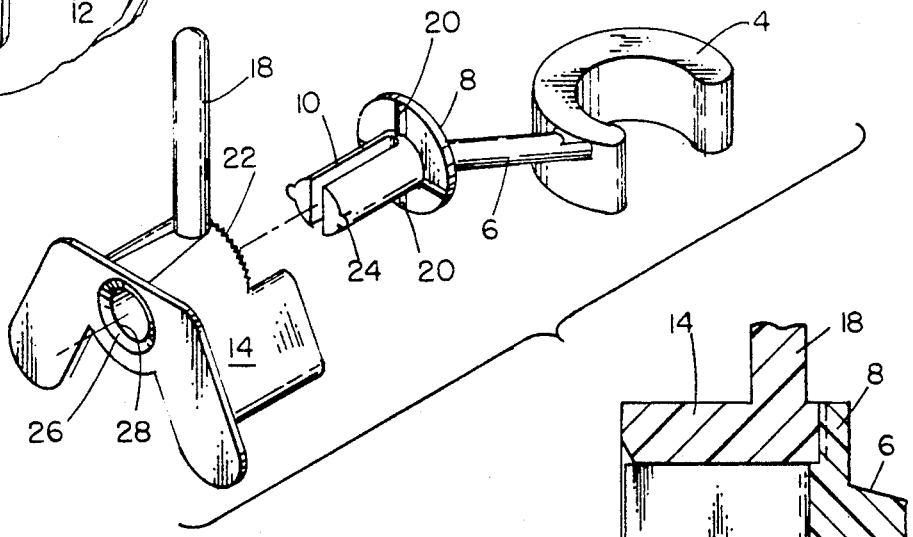
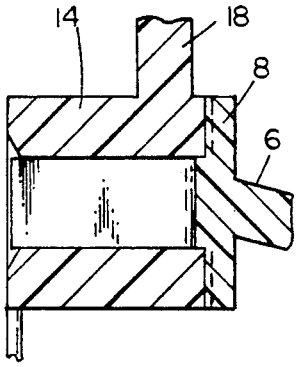
FIG. 4

DISPLAY FIXTURE FOR SPECTACLES

DESCRIPTION

1. Technical Field

This invention relates to a display fixture for spectacles and, more particularly, to a fixture which allows spectacles to be displayed in an orientation other than horizontally.

2. Background Art

Spectacles or spectacle frames which are for sale are generally displayed. One function of the display is to show the various styles to the potential purchaser, but yet another function of the display is to attract the initial attention of a potential purchaser. Over the years, spectacle displays have become more and more sophisticated, utilizing acrylic rods, slot walls and other devices to display the material in a creative fashion. One of the drawbacks of the presenting devices is that the displays are static.

Specific prior art know the present inventor include U.S. Pat. No. 319,293, granted to Merritt on June 2, 1885, which discloses an eyeglass holder in the form of a loop pin to be secured to a garment.

U.S. Pat. No. 2,884,219, granted to Glover, Apr. 28, 1959, discloses a clip for holding spectacles which includes a spring-biased closing device temporarily clamping the spectacles against the fixed backwall.

U.S. Pat. No. 4,128,224, granted to Guichard, Dec. 5, 1978, discloses a device for displaying spectacles including a base member for attachment to a support wall and a spring-biased gripping member.

U.S. Pat. No. 4,695,026, granted to Medley, Jr., Sept. 22, 1987, discloses an eyeglass holder including a base member including an outwardly projecting spring-biased jaw for clamping a pair of spectacles.

U.S. Pat. No. 4,724,966, granted to Benaksas, Feb. 6, 1988, discloses an elongated acrylic rod having a plurality of butterfly-shaped frame holders secured thereto.

U.S. Pat. No. 4,787,520 granted to Pearson, Nov. 29, 1988, discloses a tray which may be selectively snapped to a vertical post for supporting and displaying articles such as spectacles or spectacle frames.

DISCLOSURE OF THE INVENTION

With the above-noted prior art and problems in mind, it is an object of the present invention to provide a novel spectacle display device which may be quickly and easily secured to an acrylic rod or the like in an infinite variety of positions.

It is another object of the present invention to provide a spectacle display device wherein the spectacle rests upon its nosepiece with the temple pieces either extended or folded.

Yet another object of the present device is to provide a spectacle display wherein the spectacle can be selectively displayed in either a horizontal position or in a position at an angle to the horizontal.

Still a further object of the present invention is to provide a spectacle display device wherein the parts forming the spectacle display device may be indexed to various angles with respect to each other to add visual impact to the display.

BRIEF DESCRIPTION OF THE DRAWINGS

FIG. 1 is an isometric environmental view showing the present invention in a typical use situation.

FIG. 2 is an exploded view of the present invention.

FIG. 3 is a view disclosing a portion of the present invention in an alternate use situation.

FIG. 4 is a vertical section through the present invention.

BEST MODE FOR CARRYING OUT THE INVENTION

As seen in FIG. 1, the preferred embodiment of the present invention is removably secured to a vertical rod 2 made of clear acrylic or the like. The display fixture is secured to the vertical rod by means of a resilient securement means 4 in the configuration of a horseshoe when seen in plan view and having an internal dimension slightly smaller than the rod to which it is to be secured such that it can be snapped in place. Extending outwardly from one end of the securement device 4 is a interconnecting rod member 6 which includes at its outer end a disk 8 from which projects a bifurcated cylindrical member 10 which extends substantially through a frame-supporting nosepiece generally designated as 12.

It is to be noted that the nosepiece 12 is in the configuration of an inverted V having downwardly and outwardly flared side portions 14 (only one shown) and a face piece 16 which has dimensions larger than the nosepiece itself, forming a flange at the forward end providing some security and stability to the display. Extending upwardly from the rear portion of nosepiece 12 is a post 18 preventing rearward movement of the mounted frame. The configuration of the nosepiece 12 and the location of post 18 allow the frames to be selectively displayed with the temples extended or folded. As will be explained in greater detail hereinafter, the display fixture, which is the subject matter of the present application, is capable of being mounted at any one of several different angles, since the nosepiece 12 is angularly moveable with respect to the plate 8.

Reference is now had to FIG. 2 which is an exploded view of the device as shown in FIG. 1. It is to be noted that the outwardly facing face of disk 8 includes a pair of radially extending ridges 20 along a diameter and the rearwardly facing face of nosepiece 12 includes a series of serrations 22 which, as explained hereinafter interact. Note further that the forward end of bifurcated cylinder 10 has a pair of outwardly extending protrusions or dogs 24 which have an angled inner surface similar to the angle upon the chamfer 26 surrounding the cylindrical opening 28 in the nosepiece 12. The dimensions of the nosepiece and the bifurcated cylinder are such that cylinder 10 is slightly radially compressed when in position within the nosepiece and the interaction of protrusions 24 and chamfer 26 place a slight firward pressure upon the flange holding the ridges 20 in the serration grooves 22, resisting but yet permitting relative angular movement between the two objects, allowing the device to display the frames at any one of a number of angles.

As seen in FIG. 3, the nosepiece 12 includes a flat rearwardly facing surface along each of the wings 14 such that the device may be adhesively applied to a flat surface.

The interrelationship between the nosepiece 12 and the disk 8, including the bifurcated cylinder, etc, is more readily seen in the sectional view of FIG. 4.

As it can be seen, the present invention provides a attractive, yet inexpensive method of mounting eyeglasses or eye glass frames for display while allowing the display to be altered for impact.

I claim:

1. A display fixture for spectacles comprising:

a nosepiece having a face and a bore extending substantially perpendicular to its face, said nosepiece including means to retain the spectacles upon the nosepiece, and support means for securement to a relative fixed object, said support means, including a bifurcated rod extending outwardly therefrom, said rod mated with the bore in the nosepiece allowing the nosepiece to be pivoted around the rod for selective display orientation.

2. A display fixture as in claim 1 wherein the bifurcated rod means includes outwardly extending retainer means at its outer end and to restrict removal of the nosepiece.

3. A display fixture as in claim 1 wherein a plate is located at the nosepiece.

4. A display fixture as in claim 1 wherein the nosepiece includes serrations on its rearward surface to interact with ridges on the plate defining discrete positions.

* * * * *